US006659430B2

(12) United States Patent
O'Fallon

(10) Patent No.: US 6,659,430 B2
(45) Date of Patent: Dec. 9, 2003

(54) WINCH HAVING INTERNAL CLUTCH MECHANISM

(75) Inventor: Eugene P. O'Fallon, Broken Arrow, OK (US)

(73) Assignee: Paccar Inc, Bellevue, WA (US)

( * ) Notice: Subject to any disclaimer, the term of this patent is extended or adjusted under 35 U.S.C. 154(b) by 0 days.

(21) Appl. No.: 10/074,172

(22) Filed: Feb. 12, 2002

(65) Prior Publication Data

US 2003/0151037 A1 Aug. 14, 2003

(51) Int. Cl.[7] ..... B66D 1/22
(52) U.S. Cl. ..... 254/344; 254/349; 254/350
(58) Field of Search ..... 254/344, 349, 254/350, 361, 367, 379; 474/269, 146, 116; 192/85 AA, 20

(56) References Cited

U.S. PATENT DOCUMENTS

| | | | | | |
|---|---|---|---|---|---|
| 3,319,492 | A | * | 5/1967 | Magnuson | 475/12 |
| 3,848,852 | A | * | 11/1974 | Therkildsen | 254/345 |
| 4,118,013 | A | * | 10/1978 | Christison et al. | 254/344 |
| 4,128,023 | A | | 12/1978 | Kinder | 74/750 |
| 4,192,409 | A | | 3/1980 | Ueda | 192/4 |
| 4,227,680 | A | * | 10/1980 | Hrescak | 254/344 |
| 4,408,746 | A | | 10/1983 | Marsch et al. | 254/344 |
| 4,461,460 | A | * | 7/1984 | Telford | 254/344 |
| 4,790,213 | A | | 12/1988 | Lasoen | 74/740 |
| 5,184,807 | A | * | 2/1993 | Nikolov et al. | 254/344 |
| 5,967,934 | A | | 10/1999 | Ishida et al. | 475/269 |
| 6,102,827 | A | | 8/2000 | Teasdale et al. | 475/154 |

* cited by examiner

*Primary Examiner*—Kathy Matecki
*Assistant Examiner*—Evan H Langdon
(74) *Attorney, Agent, or Firm*—Howison & Arnott, LLP

(57) ABSTRACT

A winch comprises a drum rotatably mounted on a housing for winding a cable thereupon. A motor is attached to the housing, the motor supplying torque through a motor shaft. A special stage of planetary gears is mounted to the housing for transmitting torque between the motor shaft and the drum. The special stage of planetary gears includes a sun gear for receiving torque, a carrier/clutch unit and an annular ring gear encircling the carrier/clutch unit. The carrier/clutch unit includes a frame rotatably mounted to the housing and having walls defining a cavity therein, at least one circumferentially-spaced planet gear rotatably mounted on the frame for simultaneously engaging the sun gear and the ring gear, a selectively engagable clutch mounted within the cavity of the frame, and an output member which, when the clutch is engaged, can receive useful torque from the frame and, when the clutch is disengaged, cannot receive useful torque from the frame.

21 Claims, 4 Drawing Sheets

100
116
132
131
128
124
118
133
139
140
129
138b
138a
136
112
106
117
130
212
134
208
122
126
135
134
211
108
210
203
148
184
204
172
162
160
160
162
150
144
177
174
198
196
200
202
192
220
216
219
214
219
216
142
104
218
222
236
110
114
102
146
234
106
232
228
230
226
224
120
226
230

WINCH HAVING INTERNAL CLUTCH MECHANISM

TECHNICAL FIELD OF THE INVENTION

The present invention relates generally to power driven winches of the type having internal planetary gears for driving the cable drum. In one embodiment, the invention relates to a winch having an internal friction clutch mechanism for selectively connecting and disconnecting the cable drum to the power input.

BACKGROUND OF THE INVENTION

Winches using one or more sets of planetary gears to transfer torque from a power input (e.g., winch motor) to the cable drum are well known. Further, it is known to provide an internal clutch mechanism in such winches for selectively connecting and disconnecting the cable drum to the winch motor whereby, for example, the clutch can first be disengaged to allow cable to be unreeled from the drum without operating the motor, and then the clutch can be engaged to allow the motor to power the drum for reeling in the cable against the load. Where it is desirable for the drum clutch mechanism be gradually engaged and disengaged while under load, the clutch mechanism must be of the type known as a friction clutch.

Heretofore the use of internal drum friction clutch mechanisms, especially those used in high-capacity winches, for example winches used on earth-moving machines, construction equipment or heavy trucks, has presented certain disadvantages. The reduction gear train of such winches includes multiple stages of planetary gears which take up a considerable amount of space. Typically, the drum friction clutch mechanism is located at a gear stage close to the cable drum where the torque it must transmit is relatively high, and as a result, the clutch mechanism must be physically large (e.g., large diameter) to handle the high torque requirements without failing or wearing prematurely. A first disadvantage of previous designs is that the size of such high-torque friction clutches is sometimes so large that it increases the overall size of the winch, either requiring the diameter of the winch housing to be increased, or requiring the clutch to be located to one side of the cable drum, thereby increasing the overall width of the winch. Obviously, this increased size can make it much more difficult to mount a high capacity winch on existing equipment. A second disadvantage of previous designs is that the large size and/or complexity of the high-torque friction clutches results in higher cost for their components and manufacture, consequently raising the cost of the associated winch. This of course, puts the manufacturer at a competitive disadvantage.

A need therefore exists, for a winch having a design which minimizes the size of the internal drum friction clutch to reduce the overall size of the winch. A need further exists, for a high-capacity winch with internal drum friction clutch having a simplified design which reduces the costs of manufacturing the winch.

SUMMARY OF THE INVENTION

The present invention disclosed and claimed herein comprises, in one aspect thereof, a winch including a drum rotatably mounted on a housing for winding a cable thereupon. A motor is attached to the housing, the motor supplying torque through a motor shaft. A special stage of planetary gears is mounted to the housing for transmitting torque between the motor shaft and the drum. The special stage of planetary gears includes a sun gear for receiving torque, a carrier/clutch unit and an annular ring gear encircling the carrier/clutch unit. The carrier/clutch unit includes a frame rotatably mounted to the housing and having walls defining a cavity therein, at least one circumferentially-spaced planet gear rotatably mounted on the frame for simultaneously engaging the sun gear and the ring gear, a selectively engagable clutch mounted within the cavity of the frame, and an output member which, when the clutch is engaged, can receive useful torque from the frame and, when the clutch is disengaged, cannot receive useful torque from the frame.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
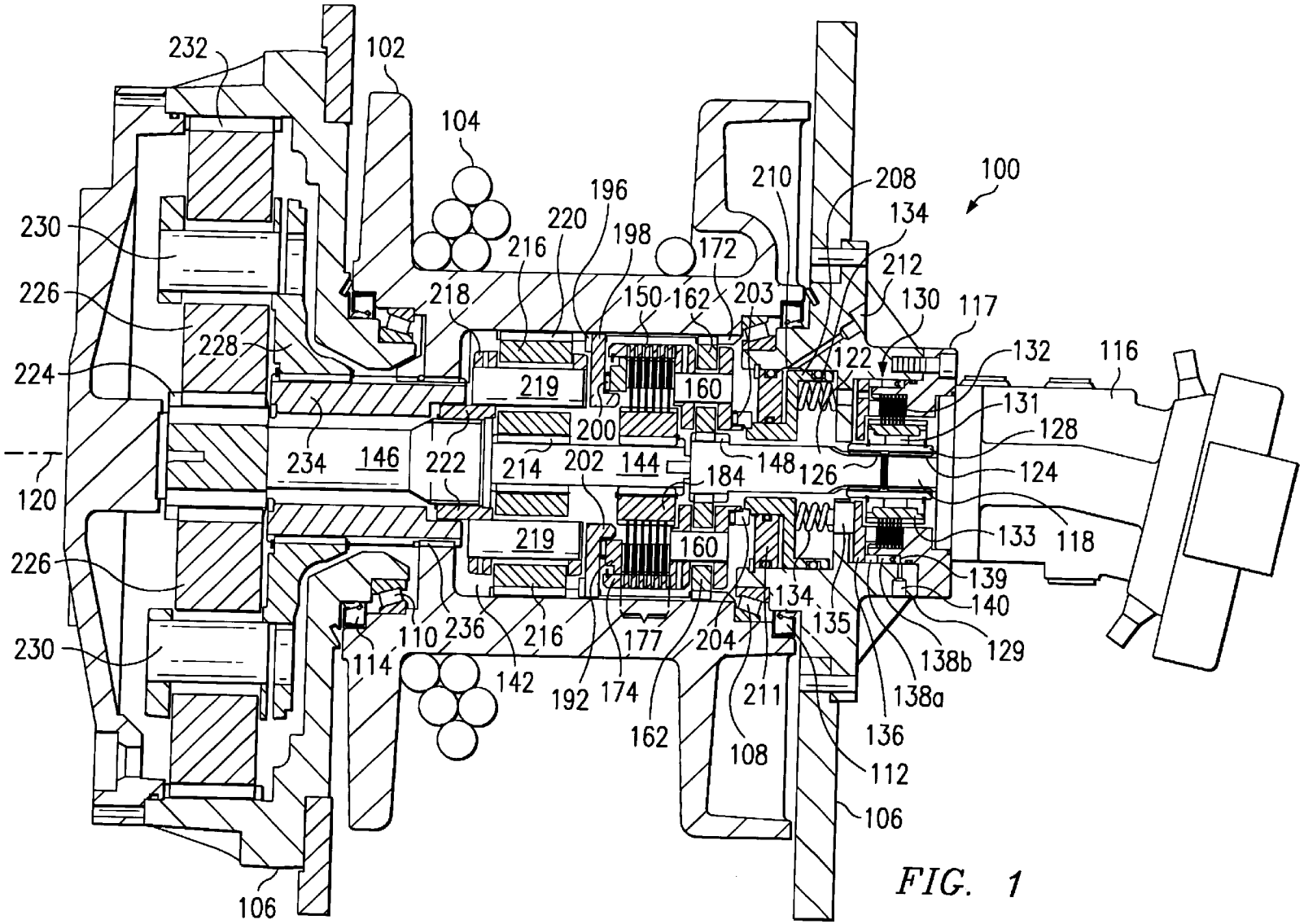
FIG. 1 illustrates a longitudinal cross sectional view through a winch in accordance with one embodiment of the current invention.

Referring now to FIG. 1, there is illustrated a hydraulic winch in accordance with one embodiment of the current invention. The winch 100 includes a cylindrical drum 102 around which a cable 104 is wound in a conventional manner. The drum 102 is rotatably supported on a housing 106 by bearing assemblies 108 and 110 located at each end. Seal assemblies 112 and 114 are provided between the housing 106 and the drum 102 to prevent dirt, water or other foreign materials from entering the internal mechanism.

Power for the winch 100 is provided by a hydraulic motor 116 mounted to a motor support 117 forming one end of the housing 106. A motor shaft 118 projects into the housing 106 along a longitudinal axis 120 providing torque to the reduction gear mechanism of the winch. As will be explained in further detail below, the reduction gear mechanism receives torque from the motor shaft 118, multiplies the torque though gear sets, and delivers the torque to the drum 102 to allow the cable 104 to be reeled onto the drum against a load.

In the embodiment shown, the reduction gear mechanism receives torque from the motor shaft 118 at a primary sun gear 122. The primary sun gear 122 has a longitudinally extending portion that extends along the axis 120 and abuts, but does not directly engage, the end of the motor shaft 118. External splines 124 on the motor shaft 118 and external splines 126 on the adjoining portion of the primary sun gear 122 are received into opposite ends of an internally splined connecting collar 128. The connecting collar 128 allows torque to be transmitted between the motor shaft 118 and the primary sun gear 122, and further connects the reduction gear mechanism to a static brake assembly 130.

The static brake assembly 130 is a safety and control feature of the winch 100 that holds the load when no power is applied to the winch and also remains applied during reel-in of the cable onto the winch drum 102. The static brake assembly 130 includes an over-running (i.e., one-way) clutch 131 disposed in the annular space between the connecting collar 128 and an encircling multi-disc brake 132. The over-running clutch 131 is preferably a sprag-type clutch, however, other types of one-way clutches may be used. The multi-disc brake 132 may be of conventional design, and it selectively connects the outer portion 133 of the over-running clutch 131 to the stationary motor support 117. When the static brake assembly 130 is applied (i.e., by engaging the brake 132) the over-running clutch 131 allows the connecting collar 128, and hence the motor shaft 118 and primary sun gear 122, to rotate freely in the reel-in direction, but it immediately locks-up (i.e., immobilizes) the collar 128, motor shaft 118 and primary sun gear 122 if they try to turn in the reel-out direction. When the static brake assembly 130 is released (i.e., by disengaging the brake 132), the connecting collar 128, motor shaft 118 and primary sun gear 122 can rotate in either direction. In use, the static brake assembly 130 typically remains applied during reel-in operation of the winch. The over-riding clutch 131 will rotate freely to haul-in a load and lock up immediately to hold the load, with no "fall back," when the winching operation is stopped. Similarly, there is no momentary "fall back" as the operator begins to haul-in as the static brake assembly 130 is not released. The static brake assembly 130 is typically released only if it necessary to rotate the motor shaft 118 and primary sun gear 122 in the reel-out direction.

Figure 2:
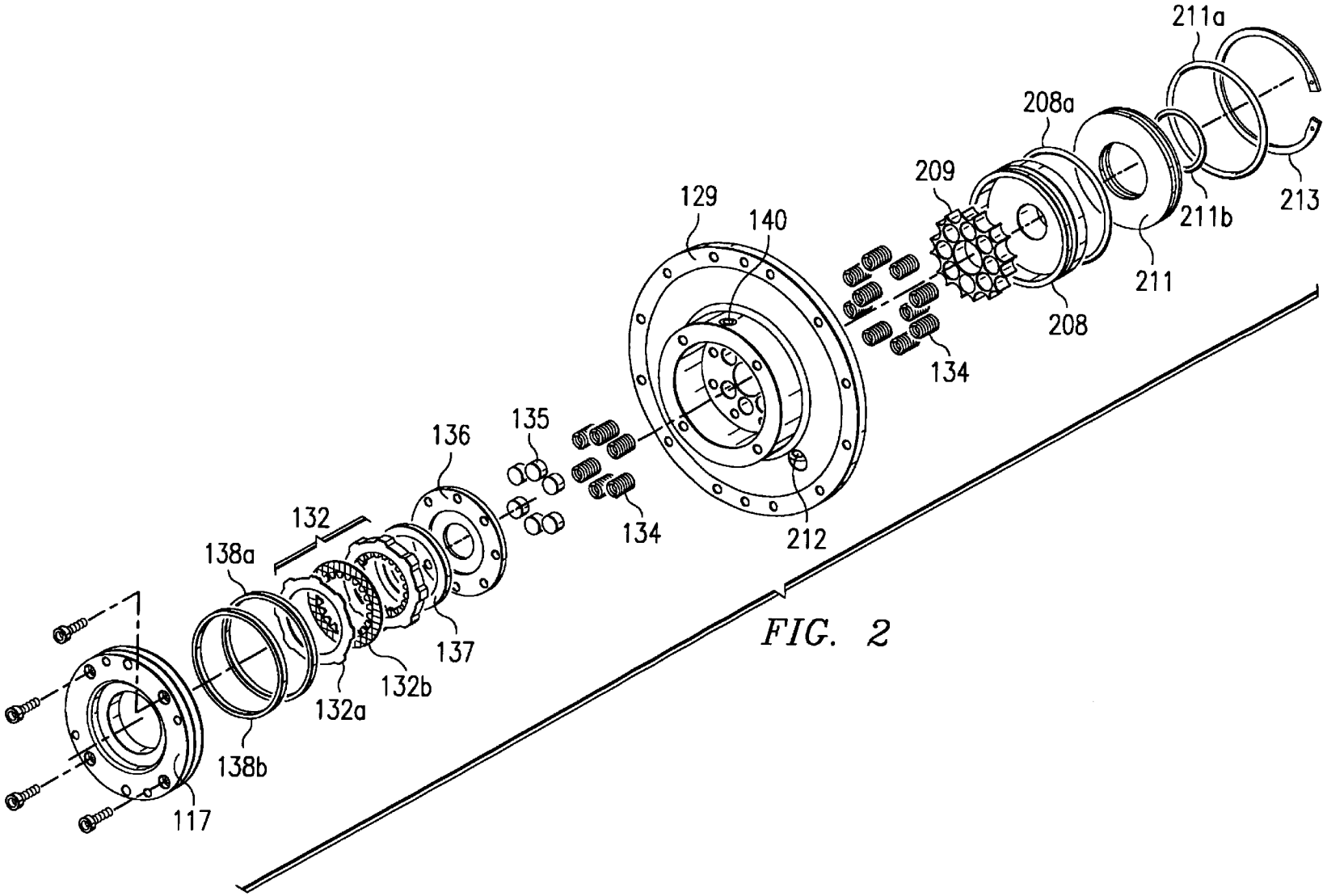
FIG. 2 illustrates an exploded perspective view of the static brake assembly and the drum friction clutch activation mechanism.

Referring now also to FIG. 2, there are illustrated additional details of a static brake assembly 130 in accordance with this embodiment. The static brake assembly 130 is spring applied and hydraulically released, and in this case is disposed within a cavity formed by attaching the motor support 117 to a brake housing 129 (both parts 117 and 129 being portions of the winch housing 106). A plurality of springs 134 extend through holes in the end wall of the brake housing 129 and push via spring pucks 135 against a movable pressure plate 136. The pressure plate 136 pushes via a spacer 137 against one side of the multi-disc brake (denoted collectively 132), compressing it against the end wall of the motor support 117. As best seen in FIG. 2, the multi-disc brake 132 comprises a plurality of externally keyed discs 132*a*, which engage the inner surface of the side wall of the motor support 117, interleaved with a plurality of internally toothed discs 132*b*, which engage the outer portion 133 (see FIG. 1) of the over-riding clutch 131. A back-up ring 138*a* and a seal ring 138*b* are disposed within an annular cavity formed between the outer surface of the side wall of the motor support 117 and the concentric inner surface of the side wall of the brake housing 129. The parts 138*a*, 138*b* and 138*c* form a piston which bears against the outer rim of the pressure plate 136 on the same side as the spacer 137.

The static brake assembly 130 of this embodiment is "applied" when the discs 132*a* and 132*b* are compressed together between the spring-biased spacer 137 and the end wall of the motor support 117, thus frictionally locking the outer member 133 of the over-riding clutch 131 to the stationary motor support 117 and preventing its rotation. The static brake assembly 130 is "released" by introducing hydraulic fluid into a cavity 139 (see FIG. 1) through a port 140 in the brake housing 129. The hydraulic fluid forces the piston made by O-ring 138*c*, seal 138*b* and back-up ring 138*a* against the pressure plate 136, overcoming the bias of the springs 134 and moving the pressure plate 136 and spacer 137 away from the brake discs 132 until their friction no longer provides substantial resistance to rotation of the outer member 133 with respect to the stationary motor support 117. It will be appreciated that, as its name implies, the static brake assembly 130 is applied and released only when the winch mechanism is stationary. Further, it functions only to prevent rotation of the winch mechanism in the reel-out direction. The static brake assembly 130 does not, and cannot, function as a drum clutch (i.e., allowing the drum 102 to move independently of the motor shaft 118) because the motor shaft 118 and the primary sun gear 122 are constantly meshed by the brake's connecting coupling 128.

As previously indicated, in this embodiment the primary sun gear 122 represents the beginning of the winch reduction gear mechanism. Multiple stages of planetary gears are then used to multiply and transmit the torque received from the motor shaft 118 to the winch drum 102. In the embodiment shown, the first two reduction gear stages are positioned inside the cylindrical cavity 142 defined by the winch drum 102. This arrangement makes maximum use of the space inside the winch housing 106 and thus helps to minimize the overall size of the winch. The sun gears for the three reduction stages, namely the primary sun gear 122, the secondary sun gear 144 and the final sun gear 146, are all located coaxially along the longitudinal axis 120. While not required, this coaxial arrangement is often preferred because of the resulting low-profile design.

The axially elongated primary sun gear 122 has external teeth 148 formed on its inner end. In a conventional planetary gear arrangement as used in prior art winches, the external teeth 148 of the primary sun gear 122 engage a plurality of circumferentially spaced planet gears mounted on a conventional carrier by means of stub shafts. These planet gears simultaneously engage an encircling ring gear in the known manner. The conventional carrier typically has internal splines or teeth in fixed constant mesh with corresponding splines or teeth on the sun gear of the next reduction stage. In this manner, torque is constantly transmitted between the first and second reduction stages in a conventional winch. In the current invention, however, a special stage of planetary gears is used which does not include a conventional planet carrier. Instead, the special stage includes a carrier/clutch unit 150 which, as further explained herein, serves as both a planetary gear carrier and as a compact friction clutch for engaging and disengaging the winch drum 102 from the motor shaft 118 to allow relative motion therebetween.

Figure 3:
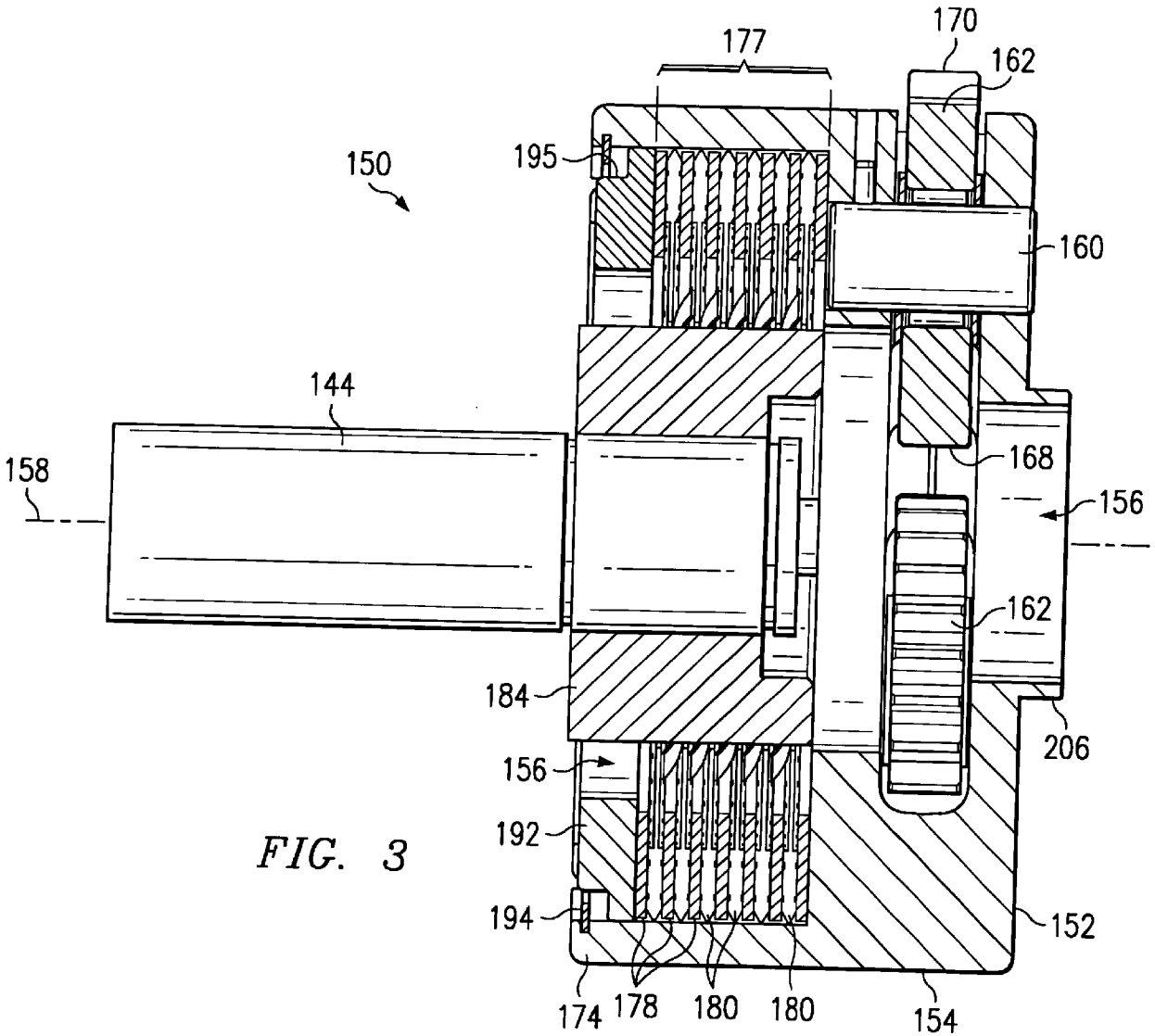
FIG. 3 illustrates an enlarged longitudinal cross sectional view through the carrier/clutch assembly of the winch.
Figure 4:
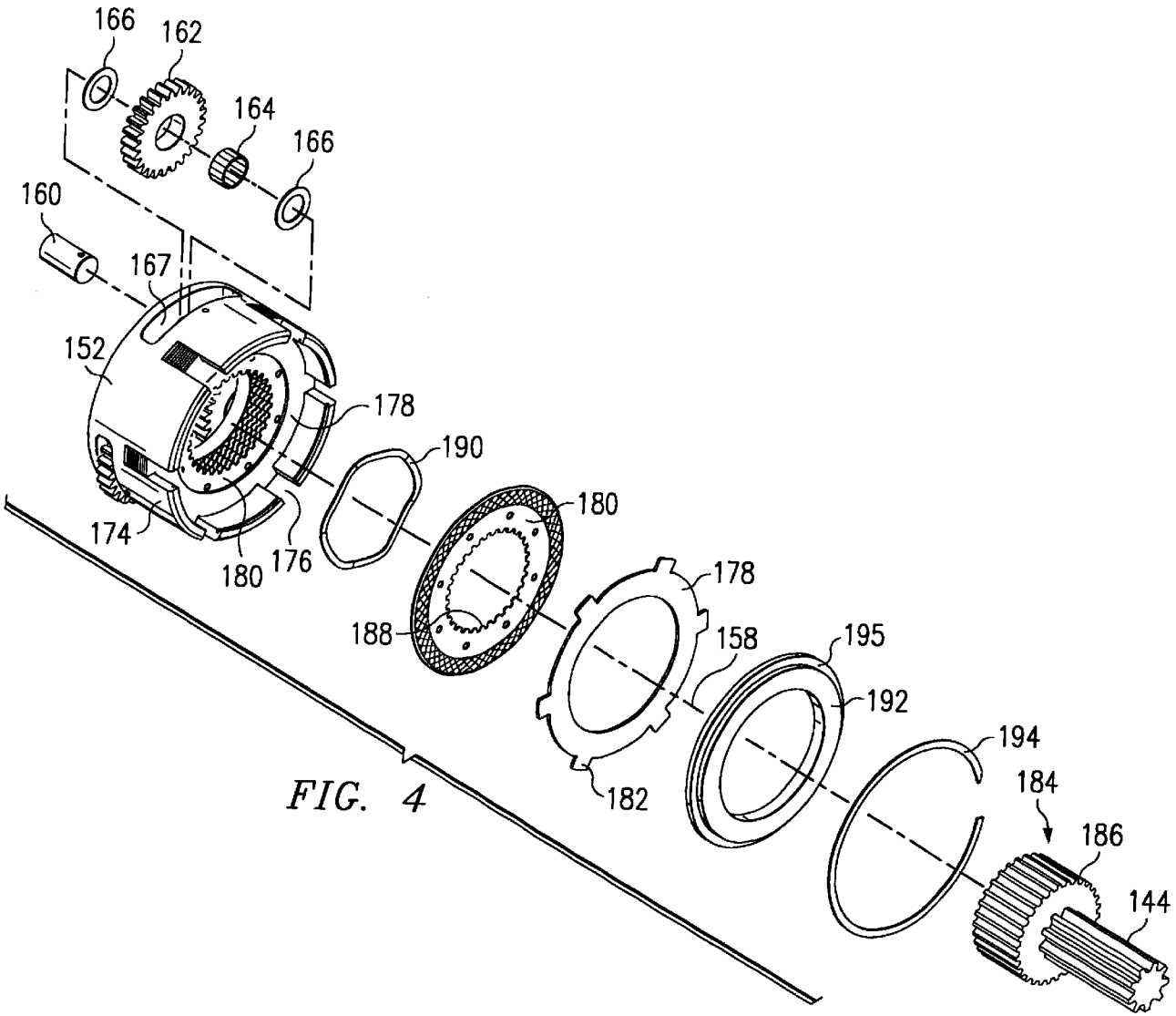
FIG. 4 illustrates an exploded perspective view of the carrier/clutch assembly.

Referring now also to FIGS. 3 and 4, there is illustrated in further detail the carrier/clutch unit 150 of this embodiment. The carrier/clutch unit 150 includes a cylindrical frame 152 defining an outer periphery 154, an inner cavity 156 and a longitudinal axis 158. In the embodiment shown, the longitudinal axis 158 of the carrier/clutch unit 150 is coincident with the longitudinal axis 120 of the winch 100. The carrier/clutch frame 152 is adapted to receive a plurality of planet gear shafts 160 that are disposed circumferentially around, and oriented parallel to, the longitudinal axis 158. A planet gear 162 is rotatably mounted on each planet gear shaft 160 by means of a bearing assembly 164 and thrust washers 166 (FIG. 4). In the embodiment shown, circumferential slots 167 are formed in the frame 152 to accommodate the planet gears 162. Each planet gear 162 is sized to extend radially outward past the outer periphery 154 of the frame 152 and radially inward into the central cavity 156 of the housing after installation. As with a conventional planetary gear carrier, the carrier/clutch unit 150 serves as part of a planetary gear stage by simultaneously engaging the planet gears 162 between the primary sun gear 122 on their radially inward sides (denoted by reference numeral 168) and an encircling ring gear on their radially outward sides (denoted by reference numeral 170). In the embodiment illustrated, the encircling ring gear is provided by internal teeth 172 integrally formed on the inside surface of the winch drum 102 (see FIG. 1). Accordingly, when the primary sun gear 122 is rotated, the frame 152 of the carrier/clutch unit 150 rotates in the same direction at a predetermined ratio.

Unlike conventional planetary gear carriers, the frame 152 of the carrier/clutch unit 150 has a longitudinally extending wall 174 in which are formed a plurality of longitudinal slots 176. A clutch (denoted generally by reference numeral 177) including a plurality of annular separators 178 interleaved with a plurality of annular friction discs 180 is disposed inside the longitudinal wall 174 within the inner cavity 156. The separators 178 have a plurality of tabs 182 disposed along their outer periphery which engage the longitudinal slots 176 of the carrier/clutch frame 152, whereby the separators are rotationally locked to the housing but can move longitudinally. It will be appreciated that while the current embodiment prevents rotation of the separator discs 178 relative to the frame 152 by mating separator tabs 182 into frame slots 176, other known locking configurations may be employed in alternative embodiments, for example, splines, gear teeth, keys and key-ways, scalloped edges, and the like. An adaptor 184 having a plurality of external splines 186 engages a plurality of teeth 188 formed on the inner annulus of each friction disc 180, whereby the friction discs are rotationally locked to the adapter, but can move longitudinally. The elongated shaft 144 of the secondary sun gear engages the adaptor 184 by means of internal splines or teeth such that the shaft and adaptor are rotationally locked together and can transmit torque therebetween. Alternatively, the secondary sun gear and the adaptor may be formed as a single integral part. A plurality of annular wave springs 190 (best seen in FIG. 4) dimensioned to fit within the annulus of the separators 178 may be interleaved between the friction discs 180 to urge the friction discs longitudinally away from one another during disengagement of the clutch 177. The wave springs 190 are preferred, but are not required. An annular pressure plate 192 is fitted into the open end of the carrier/clutch frame 152 and secured with a snap ring 194 to retain the friction discs 180 and separators 178. The pressure plate 192 is provided with an inset lip 195 which allows limited axial movement of the plate with respect to the snap ring for purposes of engaging and disengaging the clutch 177.

The clutch 177 of the carrier/clutch unit 150 is engaged by applying longitudinal force (i.e., a force directed parallel to the longitudinal axis 120 of the winch) inward against the frame 152 and the pressure plate 192, thereby urging the friction discs 180 and separators 178 to move longitudinally into increasing frictional contact with one another until the friction is sufficient to allow the desired amount of torque to be transmitted therebetween (and hence between the respectively connected carrier/clutch frame 152 and adaptor 184). The clutch 177 is disengaged by reducing the inward longitudinal force on the housing and pressure plate, whereby the frictional contact between the friction discs 180 and separators 178 is reduced to the point that useful torque cannot be transmitted therebetween. Put another way, when the clutch 177 of the carrier/clutch unit 150 is engaged, the carrier/clutch frame 152 and the adaptor 184 (with the secondary sun gear shaft 144) rotate together. When the clutch is disengaged, the frame 152 and the adaptor 184 (with the secondary sun gear shaft 144) are uncoupled and thus may rotate with respect to one another.

Since the carrier/clutch unit 150 is disposed within the central cavity 142 of the cable drum 102, it is necessary to provide means for applying and releasing longitudinal force to the unit (needed to activate the clutch 177) while still allowing the unit to rotate freely. In the embodiment illustrated in FIG. 1, a snap ring 196 is fitted into a groove formed approximately midway along the interior wall of the drum 102. The snap ring 196 provides longitudinal support for an abutting thrust ring 198. The thrust ring 198, in turn, provides longitudinal support for the carrier/clutch unit 150 by pressing laterally against the pressure plate 192 via a bearing assembly 200. The thrust ring 198 also provides radial support for the bearing assembly 200 with its annular lip 202. To ensure that the thrust ring 198 does not rotate under the influence of the bearing assembly 200, the periphery of the thrust ring is preferably provided with external teeth which engage the internal teeth 172 of the drum 102. Alternately, a key or other known securing mechanism may be provided to prevent rotation of the thrust ring. The opposite end of the carrier/clutch unit 150 is supported by a bearing assembly 203 and a race 204 that bears longitudinally against the frame 152 and surrounds the housing lip 206 (see FIG. 3) to position the unit radially. The opposite side of the race 204, in turn, is supported by a moveable stepped piston 208 that is slidingly disposed within a cylindrical portion of the brake housing 129.

Longitudinal compressive force on the carrier/clutch frame 152 (i.e., for engaging the clutch 177) is provided by springs 134 via the piston 208, race 204 and bearing assembly 203. It will be appreciated that some of the springs 134 acting on the drum clutch 177 extend through holes in the brake housing 129 and also act upon the multi-disk brake 132 as previously described, while others of the springs 134 are compressed against the end wall of the brake housing and act only upon the drum clutch. This dual-use design eliminates the need for separate springs just to activate the brake 132, and may also reduce the overall width of the winch. A spacer 209 may be provided to position the springs 134 within the cavity formed behind the stepped piston 208. The force from springs 134 urges the carrier/clutch frame 152 to move longitudinally toward the stationary thrust ring 198, thereby compressing the friction discs 180 and separators 178 together in frictional engagement such that torque can be transmitted therebetween. The clutch 177 is disengaged by introducing hydraulic fluid into a cavity 210 formed between the stepped piston 208 (sealed by O-ring 208*a*) and a seal ring 211 (sealed by external O-ring 211*a* and internal O-ring 211*b*). The seal ring 211 is fixed in place longitudinally by a snap ring 213 fitted to the brake housing 129, and the hydraulic fluid enters the cavity 210 via a port 212 in the brake housing. The hydraulic fluid in cavity 210 forces the stepped piston 208 longitudinally away from the fixed seal ring 211, overcoming the bias of the springs 134 and allowing the frame 152 of the carrier/clutch unit 150 to move away from the pressure plate 192. This uncompresses the separators 178 and friction discs 180 of the clutch 177 such that their frictional engagement is significantly reduced. Thus, it will be readily appreciated that the torque transmitted by the carrier/clutch unit 150 (and hence the torque transmitted from the motor shaft 118 to the winch drum 102), can be varied by controlling the pressure of the hydraulic fluid in the cavity 210.

The carrier/clutch unit 150 allows the functions of a clutch and a planetary gear carrier to be combined into a very compact unit. If the clutch is engaged, input torque at the sun gear 122 is transmitted as multiplied output torque at the output shaft 144. If the clutch is not engaged, input torque at the sun gear 122 is not transmitted to the output shaft 144. This has advantages from the standpoint of cost and space requirements.

When the clutch 177 is fully engaged, torque is transmitted by the carrier/clutch unit 150 from the motor shaft 118 to the secondary sun gear 144 just as with a conventional planetary gear carrier. The secondary sun gear 144, in turn, has external teeth 214 formed on the end opposite the carrier/clutch unit. These external teeth 214 of the secondary sun gear 144 engage a plurality of circumferentially spaced secondary planet gears 216 mounted on a conventional carrier 218 by means of shafts 219. The secondary planet gears 216 simultaneously engage a ring gear encircling the carrier. In the illustrated embodiment, the encircling ring gear for the secondary planetary set is provided by internal teeth 220 integrally formed on the inside surface of the winch drum 102. For purposes of reducing production costs, the internal teeth 220 for the secondary ring gear and the internal teeth 172 for the primary ring gear may be part of the same set of integrally formed gear teeth. In other embodiments, however, the internal teeth of the primary and secondary ring gears may have different tooth pitches and/or may be separately formed rings that are secured in place around their respective planetary set.

As the secondary sun gear 144 rotates, the secondary carrier 218 will rotate in the same direction at a predetermined ratio, thereby multiplying the transmitted torque in the known manner. The secondary carrier 218 maintains fixed constant engagement with the final sun gear 146 by means of splines 222 such that torque can be transmitted therebetween. The final sun gear 146 has external teeth 224 formed on the end opposite the secondary planetary stage. These external teeth 224 may be integrally formed as part of the final sun gear 146, or alternatively, the final sun gear may be formed from a separate shaft portion and a separate toothed portion which are splined or otherwise joined together. The external teeth 224 of the final sun gear 146 engage a plurality of circumferentially spaced final planet gears 226 mounted on a conventional carrier 228 by means of shafts 230. The final planet gears 226 simultaneously engage a ring gear 232 encircling the final carrier 228. It will be appreciated that, as the torque increases with each succeeding planetary stage, the size of the associated sun gear, planet gears and carrier will also increase to handle the necessary loads. Thus, in the illustrated embodiment, the final ring gear 232 is much larger than the secondary ring gear 220, and is therefore mounted to one side of the winch drum 102. As the final sun gear 146 rotates, the final carrier 228 will rotate in the same direction at a predetermined ratio as previously described, thus further multiplying the transmitted torque. The final carrier 228 is splined to one end of a drum shaft 234, and the opposite end of the drum shaft is splined to an internal drum spline 236 on the drum 102. In this manner, the output torque from the final carrier 228 is transmitted to the winch drum 102, thus completing the transfer of power from the motor shaft 118 to the winch drum.

It will be readily apparent that the winch 100, which includes the drum friction clutch after the first stage of gear reduction, substantially reduces the torque-carrying requirements for the clutch in comparison to a winch where the friction clutch is provided after the second or third stage of gear reduction (i.e., where the torques being transmitted are proportionally higher). Thus, the winch 100 can use a friction clutch that is much smaller and/or less expensive to manufacture than other designs. In addition, the use of the carrier/clutch unit 150 incorporating both a planetary carrier and a friction clutch in a single unit further simplifies production of the winch and reduces costs. Further still, use of a common set of springs to activate both the drum clutch and the static brake of the winch also reduces the parts count, further simplifies production, and reduces costs for the winch. Finally, mounting the carrier/clutch unit within the internal cavity of the winch drum makes excellent use of the available space within the winch housing so as to provide for a more compact unit.

Although the preferred embodiment has been described in detail, it should be understood that various changes, substitutions and alterations can be made therein without departing from the spirit and scope of the invention. For example, in another embodiment of the invention, the carrier/clutch unit may be disposed between the secondary sun gear and the final sun gears, rather than between the primary sun gear and the secondary sun gear. In yet another embodiment, the winch may have only two stages of gear reduction, and the entire gear reduction mechanism, including a carrier/clutch unit, maybe disposed within the internal cavity of the winch drum. In still another embodiment, the winch may have only a single stage of gear reduction, but will incorporate a carrier/clutch unit sharing common springs with the static brake assembly. In yet another embodiment, all of the reduction gear sets, including the set incorporating the carrier/clutch unit, may be disposed outside the winch drum. In still another embodiment, some of the winch's reduction gear sets including the carrier/clutch unit may be disposed along a first longitudinal axis, other of the reduction gear sets may be disposed along a second, parallel longitudinal axis, and the gear sets on the two axes are connected by a set of engaged gears, a chain/sprocket arrangement, or other torque transmitting means. In yet other embodiments, the relative movements of the components of planetary gear sets may be rearranged in the known manner. These and other embodiments are defined by the claims as appended hereto.

What is claimed is:

1. A winch comprising:

a drum rotatably mounted on a housing for winding a cable thereupon;

a motor attached to the housing, the motor supplying torque through a motor shaft;

an augmented stage of planetary gears mounted to the housing for transmitting torque between the motor shaft and the drum, the augmented stage of planetary gears including a sun gear for receiving torque, a carrier/clutch unit and an annular ring gear encircling the carrier/clutch unit;

the carrier/clutch unit including a frame rotatably mounted to the housing and having walls defining a cavity therein;

at least one circumferentially-spaced planet gear rotatably mounted on the frame for simultaneously engaging the sun gear and the ring gear;

a selectively engagable clutch mounted within the cavity of the frame;

an output member which, when the clutch is engaged, can receive useful torque from the frame and, when the clutch is disengaged, cannot receive useful torque from the frame and a static brake assembly including a over-riding clutch and a multi-disc brake, the static brake assembly being operably connected to the motor shaft.

2. A winch in accordance with claim 1, further comprising:

at least one conventional stage of planetary gears connected in series with the at least one augmented stage of planetary gears for transmitting torque between the motor shaft and the drum, each conventional stage of planetary gears comprising a sun gear for receiving torque, a carrier having at least one circumferentially-spaced planet gear rotatably mounted thereon, and an annular ring gear encircling the carrier.

3. A winch in accordance with claim 2, wherein the winch includes one augmented planetary stage and at least two conventional stages of planetary gears connected in series for transmitting torque between the motor shaft and the drum.

4. A winch in accordance with claim 3, wherein the augmented planetary gear stage receives torque from the motor shaft with no intervening gear stages.

5. A winch in accordance with claim 3, wherein the augmented planetary gear stage and at least one conventional planetary gear stage share a common annular ring gear.

6. A winch in accordance with claim 5, wherein the common annular ring gear is integrally formed on the interior surface of the drum.

7. A winch in accordance with claim 3, wherein the augmented planetary gear stage and at least one conventional planetary gear stage are disposed within the drum.

8. A winch in accordance with claim 1, wherein the clutch of the carrier/clutch unit is spring applied and the multi-disc brake of the static brake assembly is spring applied.

9. A winch in accordance with claim 1, wherein at least some of the springs applying the clutch of the carrier/clutch unit are the same springs applying the multi-disc brake of the static brake assembly.

10. In a winch having a housing, a rotating cylindrical winch drum mounted on the housing, a motor mounted to the housing and supplying torque at a motor shaft, and a reduction gear train including a primary planetary gear stage and a secondary planetary gear stage for sequentially transmitting torque from the motor shaft to the winch drum, the improvement comprising:

one of the primary planetary gear stage and the secondary planetary gear stage including a carrier/clutch unit;

the carrier/clutch unit including a frame rotatably mounted to the housing and having walls defining a cavity therein;

at least one circumferentially-spaced planet gear rotatably mounted on the frame for simultaneously engaging a sun gear and an encircling ring gear;

a selectively engagable clutch mounted within the cavity of the frame;

an output member which, when the clutch is engaged, can receive useful torque from the frame and, when the clutch is disengaged, cannot receive useful torque from the frame; and a static brake assembly including an over-riding clutch and a multi-disc brake, the static brake assembly being operably connected to the motor shaft.

11. A winch in accordance with claim 10, wherein the frame of the carrier/clutch unit further comprises:

a radial portion; and a circumferential portion extending longitudinally away from the radial portion, the circumferential portion defining the interior cavity.

12. A winch in accordance with claim 11, wherein the clutch of the carrier/clutch unit further comprises:

a plurality of annular separator discs concentrically positioned within the interior cavity around a longitudinally disposed output shaft, the separator discs being rotationally locked with respect to the circumferential portion of the housing and free to rotate with respect to the output shaft;

a plurality of annular friction discs concentrically positioned around the output shaft and interleaved between the separator discs, the friction discs being rotationally locked with respect to the output shaft and free to rotate with respect to the circumferential portion of the housing;

wherein compressing the separator discs longitudinally together frictionally engages the friction discs with the separator discs, allowing the transmission of torque between the sun gear and the output shaft, whereas uncompressing the separator discs frictionally disengages the friction discs from the separator discs such that the output shaft may rotate independently from the sun gear.

13. A winch in accordance with claim 12, wherein the carrier/clutch unit is disposed within an interior cavity of the cylindrical winch drum.

14. A winch in accordance with claim 12, wherein the carrier/clutch unit is disposed between a sun gear of the primary planetary stage and a sun gear of the secondary planetary stage.

15. A winch in accordance with claim 12, wherein the sun gear engaged by the planet gears of the carrier/clutch unit is the primary sun gear.

16. A winch in accordance with claim 12, wherein the ring gear engaged by the planet gears of the carrier/clutch unit is mounted to an interior surface of the winch drum.

17. A winch comprising:

a support housing;

a winch drum rotatably mounted on said housing, the winch drum having a cylindrical cavity formed therein with an inner surface;

a motor mounted to the support housing and providing torque at a motor shaft projecting therefrom;

a primary sun gear connected to the motor shaft for receiving torque therefrom;

a common internally toothed ring gear formed on the inner surface of the winch drum;

a primary planet carrier positioned within the interior cavity of the winch drum, the primary planet carrier including a generally cylindrical housing having a radial wall and a circumferential wall extending axially away from the radial wall, the radial wall supporting a plurality of planet gears in radially meshed engagement with the primary sun gear and the common ring gear;

a primary output shaft concentrically positioned at least partially within the interior cavity of the carrier housing;

a clutch including a plurality of separator discs concentrically positioned around the primary output shaft within the interior cavity, the separator discs being rotationally locked with respect to the circumferential wall and free to rotate with respect to the output shaft;

a plurality of friction discs concentrically positioned around the output shaft and interleaved between the separator discs, the friction discs being rotationally locked with respect to the output shaft and free to rotate with respect to the circumferential wall;

wherein compressing the separator discs axially together frictionally engages the friction discs with the separator discs, allowing the transmission of torque between the carrier housing and the primary output shaft, whereas releasing the compression allows the separators to frictionally disengage the friction discs such that the carrier housing may rotate independently from the primary output shaft;

a secondary sun gear positioned within the interior cavity and fixed to the primary output shaft;

a secondary planet carrier positioned within the interior cavity of the winch drum, the secondary planet carrier supporting a plurality of planet gears in radially meshed engagement with the secondary sun gear and the common ring gear; and a secondary output shaft rotatably mounted in the housing and connected to the secondary planet carrier to rotate with the secondary planet carrier; and a static brake assembly including a over-riding clutch and a multi-disc brake, the static brake assembly being operably connected to the motor shaft.

18. A winch in accordance with claim 17, wherein clutch of the primary planet carrier is spring applied and the multi-disc brake of the static assembly is spring applied.

19. A winch in accordance with claim 18, wherein at least some of the springs applying the clutch of the primary planet carrier are the same springs applying the multi-disc brake of the static brake assembly.

20. A winch in accordance with claim 5, wherein the winch drum has internal teeth integrally formed on the inside surface of the drum itself constituting the common annular ring gear.

21. A winch in accordance with claim 17, wherein the winch drum has internal teeth integrally formed on the inside surface of the drum itself constituting the common annular ring gear.

* * * * *